US011800274B2

(12) United States Patent
Chu

(10) Patent No.: US 11,800,274 B2
(45) Date of Patent: Oct. 24, 2023

(54) EARPHONE WITH A CIRCUIT BOARD MODULE

(71) Applicant: Merry Electronics(Shenzhen) Co., Ltd., ShenZhen (CN)

(72) Inventor: Keng-Yi Chu, Taichung (TW)

(73) Assignee: Merry Electronics(Shenzhen) Co., Ltd., ShenZhen (CN)

( * ) Notice: Subject to any disclaimer, the term of this patent is extended or adjusted under 35 U.S.C. 154(b) by 15 days.

(21) Appl. No.: 17/710,986

(22) Filed: Mar. 31, 2022

(65) Prior Publication Data

US 2023/0269520 A1 Aug. 24, 2023

(30) Foreign Application Priority Data

Feb. 23, 2022 (TW) ..... 111106536

(51) Int. Cl.
*H04R 25/00* (2006.01)
*H04R 1/10* (2006.01)

(52) U.S. Cl.
CPC ..... *H04R 1/1066* (2013.01); *H04R 1/1016* (2013.01); *H04R 1/1075* (2013.01); *H04R 2420/07* (2013.01)

(58) Field of Classification Search
CPC ..... H04R 1/1016; H04R 2460/13; H04R 25/602; H04R 25/65; H04R 2225/77
See application file for complete search history.

(56) References Cited

U.S. PATENT DOCUMENTS

2021/0211795 A1* 7/2021 Wang ..... G02C 5/22
2021/0352394 A1* 11/2021 Wen ..... H04R 1/10

* cited by examiner

*Primary Examiner* — Amir H Etesam
(74) *Attorney, Agent, or Firm* — JCIPRNET

(57) ABSTRACT

An earphone with a circuit board module includes a casing, a speaker, and a circuit board module. The casing includes a back cover and has an accommodation space inside. The speaker is disposed in the accommodation space, and a first chamber is defined between the speaker and the back cover. The circuit board module is disposed in the first chamber and includes a first circuit board having a first surface, a second circuit board having a second surface, and a first flexible connector. The first surface faces and is spaced apart from the second surface of the second circuit board. The first flexible connector includes a first end connected to the first circuit board, a second end which is opposite to the first end and connected to the second circuit board, and a connection segment which connects the first and second ends and is shaped as a letter U.

9 Claims, 6 Drawing Sheets

EARPHONE WITH A CIRCUIT BOARD MODULE

CROSS-REFERENCE TO RELATED APPLICATION

This application claims the priority benefit of Taiwan patent application no. 111106536, filed on Feb. 23, 2022. The entirety of the above-mentioned patent application is hereby incorporated by reference herein and made a part of this specification.

BACKGROUND

Technical Field

The disclosure relates to an earphone; more particularly, the disclosure relates to an earphone with a circuit board module.

Description of Related Art

Under the circumstances that consumers are looking for light and convenient earphones and the pertinent production technology of earphones tends to be mature, "true wireless" earphones that connect electronic devices in a wireless manner have gradually become mainstream products in the earphone market. Generally, a true wireless earphone is required to include various electronic elements inside, such as circuit boards, batteries, antennas, microphones, speakers, and so forth, which significantly occupies the internal space of the earphone. Therefore, how to effectively reduce the volume of true wireless earphones and improve the flexibility of space arrangements to meet the consumers' requirements for light weight and convenience has become the research focus in the pertinent field.

SUMMARY

The disclosure provides an earphone with a circuit board module; a length and width dimension of the earphone may be effectively reduced, and flexibility of space arrangement in the earphone is improved.

In an embodiment of the disclosure, an earphone including a casing, a speaker, and a circuit module. The casing includes a back cover and an accommodation space inside. The speaker is disposed in the accommodation space of the casing, and a first chamber is defined between the speaker and the back cover. The circuit board module is disposed in the first chamber. The circuit board module includes a first circuit board, a second circuit board, and a first flexible connector. The first circuit board includes a first surface. The second circuit board includes a second surface, and the first surface of the first circuit board faces and is spaced apart from the second surface of the second circuit board. The first flexible connector includes a first end, a second end opposite to the first end, and a connection segment connecting the first end and the second end. Here, the first end is connected to the first circuit board, the second end is connected to the second circuit board, and the connection segment is shaped as a letter U.

According to an embodiment of the disclosure, the first circuit board includes a cavity recessed from an edge, and the first end of the first flexible connector extends into the cavity.

According to an embodiment of the disclosure, the first circuit board includes an electronic device located on the first surface, and the electronic device is located between the first surface of the first circuit board and the second surface of the second circuit board.

According to an embodiment of the disclosure, the second circuit board leans against the electronic device, and a dimension of the second circuit board is smaller than a dimension of the first circuit board.

According to an embodiment of the disclosure, an adhesion layer is arranged on the second surface of the second circuit board, and the second circuit board is adhered to the electronic device through the adhesion layer.

According to an embodiment of the disclosure, the back cover of the casing has an extension stem, a second chamber is defined in the extension stem, and the second chamber is adjacent to the first chamber.

According to an embodiment of the disclosure, the earphone further includes a third circuit board and a second flexible connector, and the third circuit board is disposed in the second chamber and electrically connected to the first circuit board through the second flexible connector.

According to an embodiment of the disclosure, the second flexible connector includes a third end and a fourth end opposite to each other, and the third end and the fourth end respectively extend along a direction away from each other.

According to an embodiment of the disclosure, the first circuit board includes an electronic device located on the first surface, the electronic device is an active device, and the second circuit board includes a third surface opposite to the second surface and a solder pad located on the third surface.

According to an embodiment of the disclosure, the earphone further includes a battery or a microphone, and the battery or the microphone is connected to the solder pad through a conductive wire.

In view of the above, in the earphone with the circuit board module as provided in one or more embodiments of the disclosure, the second circuit board covers the first circuit board, so that the first surface of the first circuit board faces the second surface of the second circuit board, and the first circuit board and the second circuit board are connected to each other through the first flexible connector. As such, the overall length and width dimension of the circuit board module is smaller than the overall length and width dimension of all elements of the first circuit board and the second circuit board on the same plane. Thereby, different arrangements of the elements may be achieved to improve the flexibility of the space arrangement of the earphone and comply with consumers' requirements for light weight and convenience of the earphone.

To make the above more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

DESCRIPTION OF THE EMBODIMENTS

Figure 1:
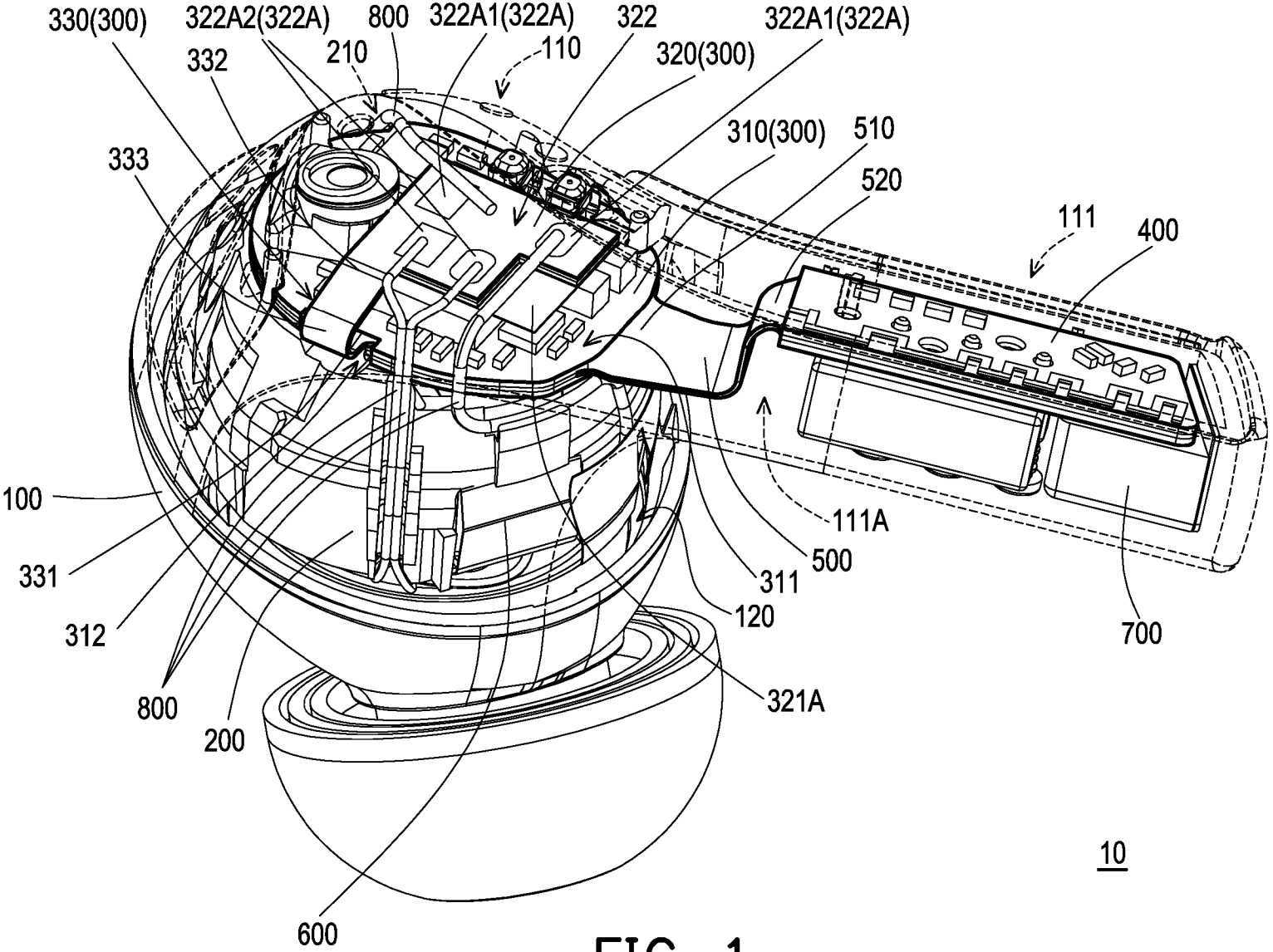
FIG. 1 is a three-dimensional view of an earphone with a circuit board module according to an embodiment of the disclosure.
Figure 2A:
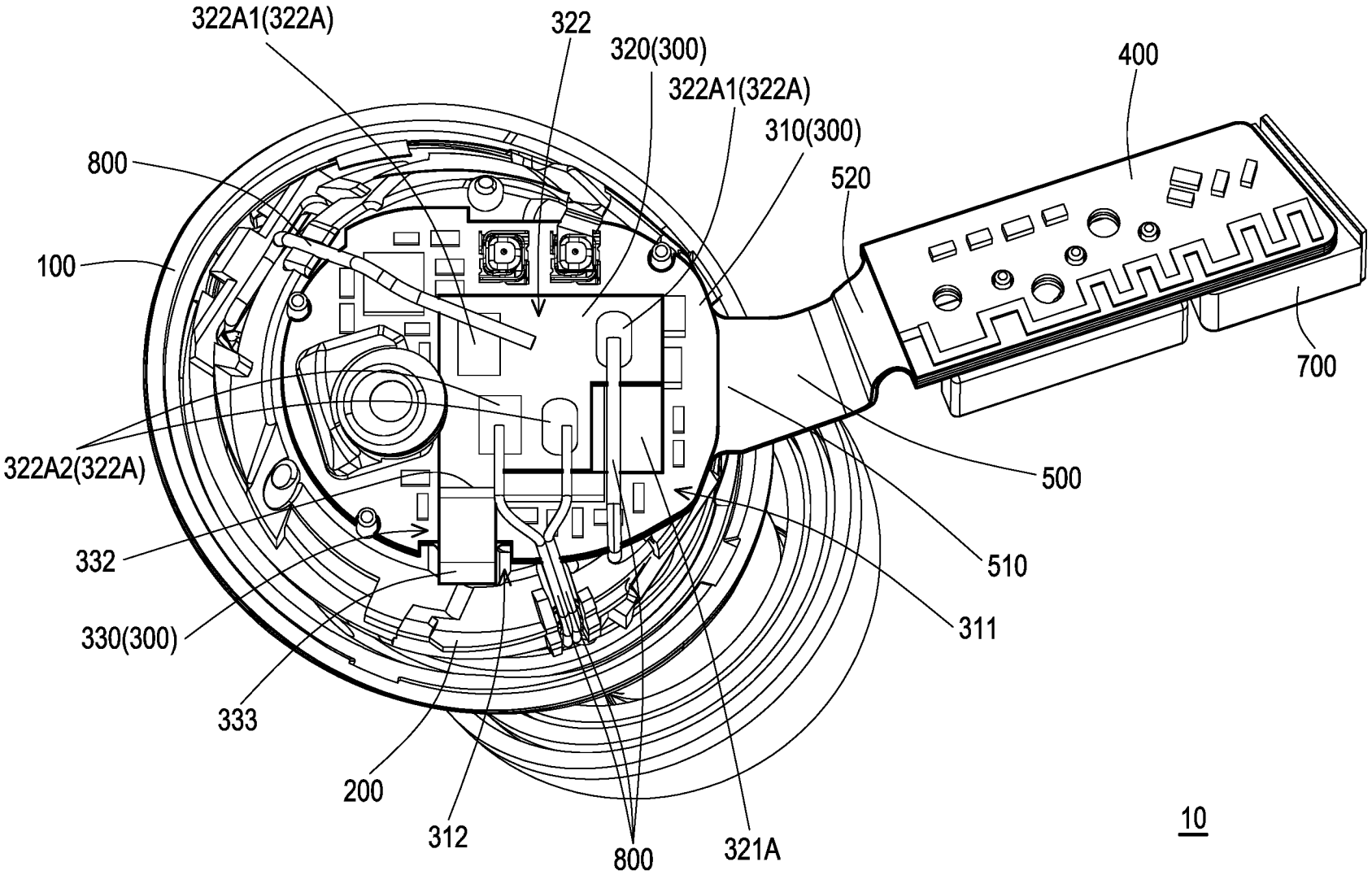
FIG. 2A is a three-dimensional view illustrating some components of the earphone depicted in FIG. 1.
Figure 2B:
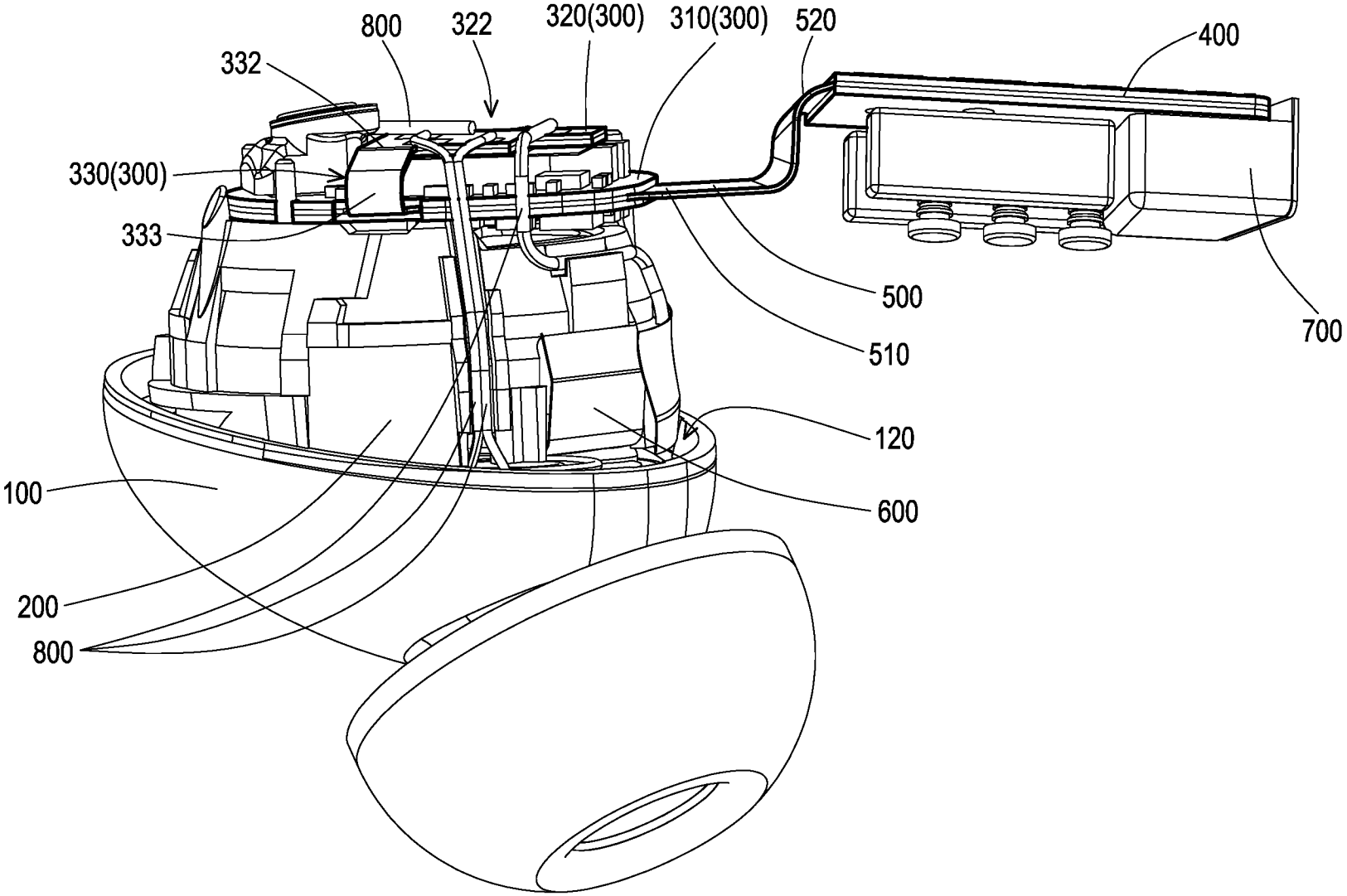
FIG. 2B is a side view of the earphone depicted in FIG. 2A.
Figure 2C:
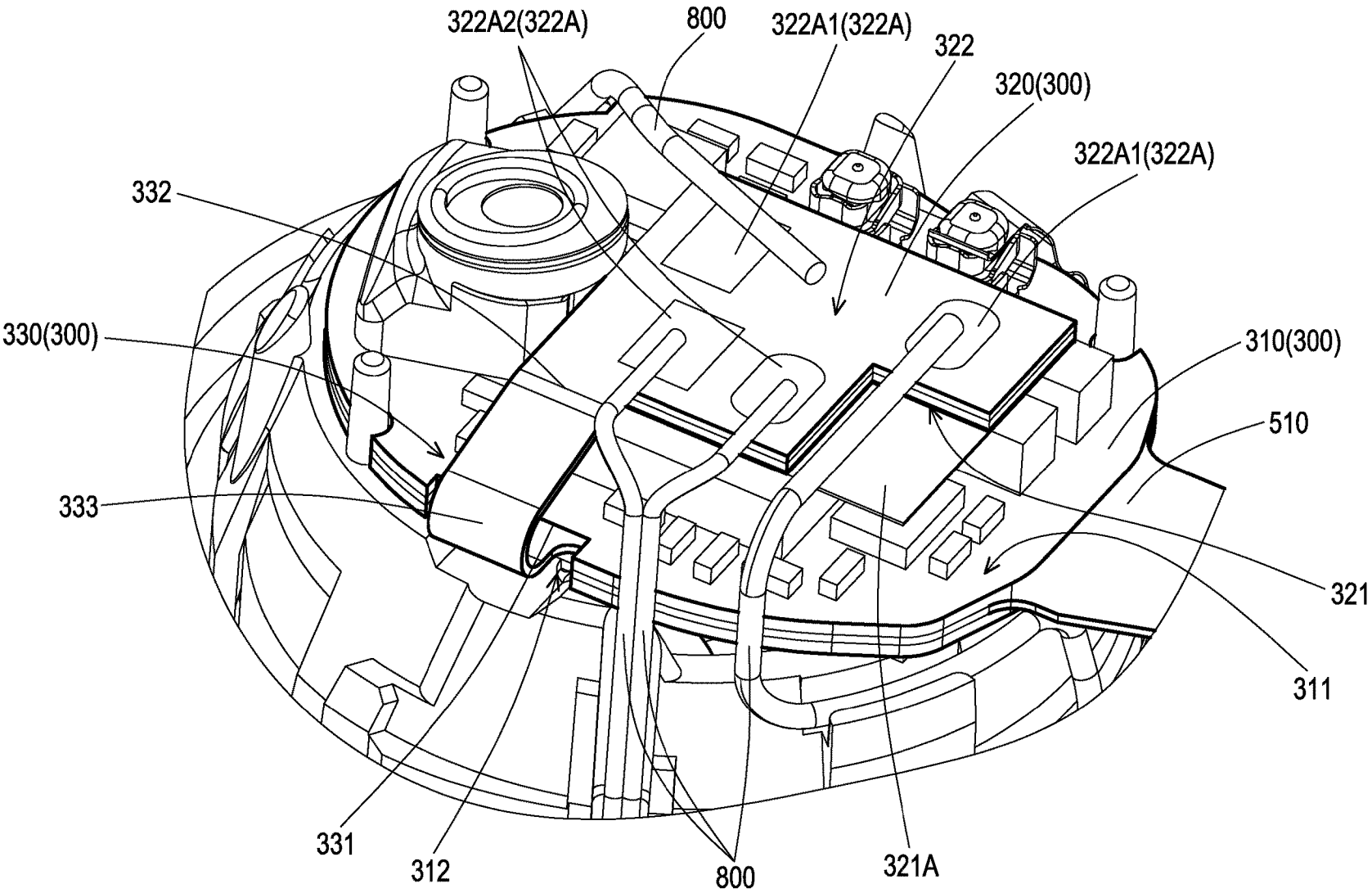
FIG. 2C is a partial enlarged view illustrating some components of the earphone depicted in FIG. 1.
Figure 3:
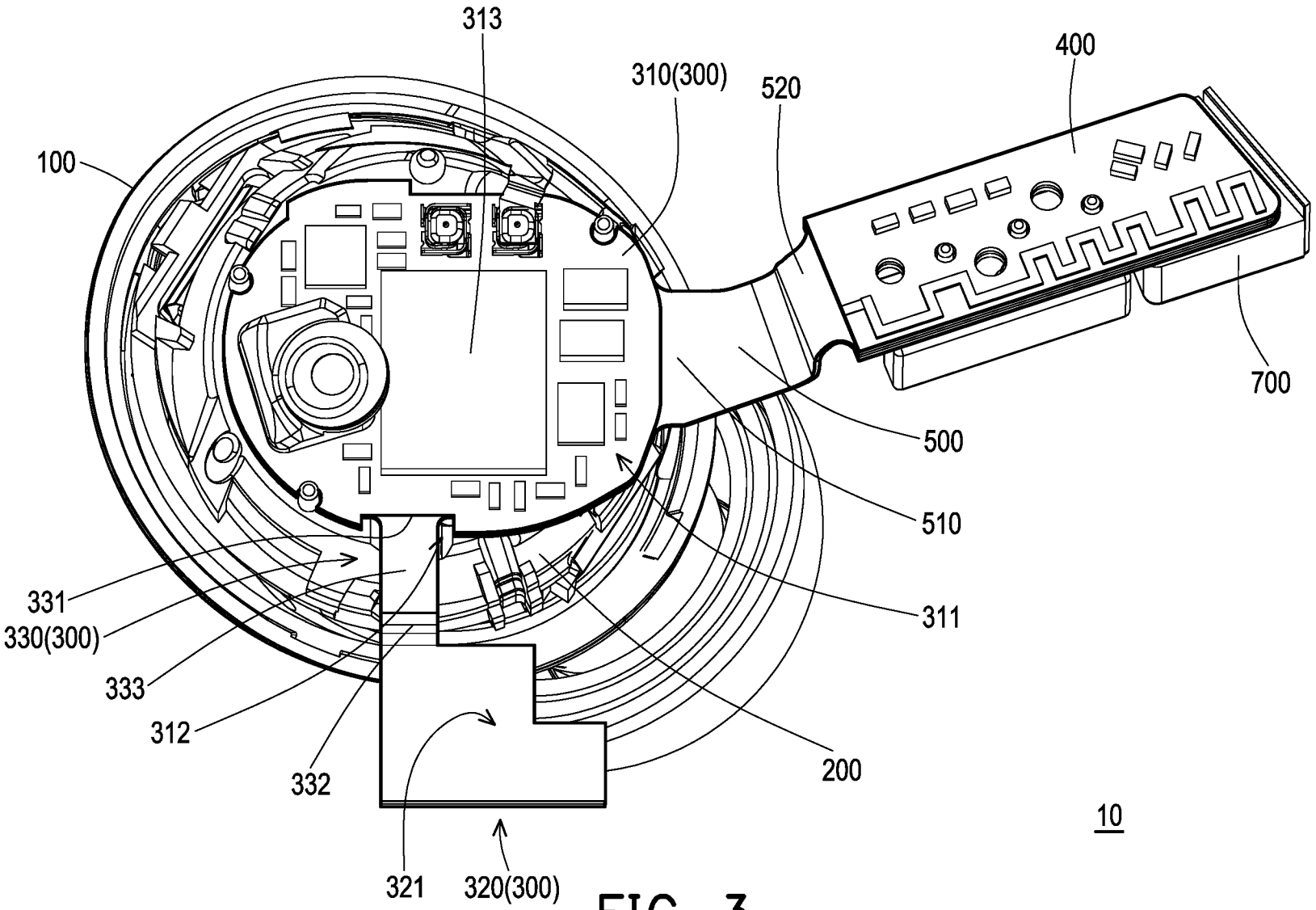
FIG. 3 is a three-dimensional view illustrating the second circuit board of the earphone depicted in FIG. 2A is flipped from the first circuit board.

FIG. 1 is a three-dimensional view of an earphone with a circuit board module according to an embodiment of the disclosure. FIG. 2A is a three-dimensional view illustrating some components of the earphone depicted in FIG. 1. FIG. 2B is a side view of the earphone depicted in FIG. 2A. FIG. 2C is a partial enlarged view illustrating some components of the earphone depicted in FIG. 1. FIG. 3 is a three-dimensional view illustrating a second circuit board of the earphone depicted in FIG. 2A is flipped from a first circuit board.

With reference to FIG. 1, FIG. 2A, and FIG. 3, an earphone 10 provided in this embodiment includes a casing 100, a speaker 200, and a circuit board module 300. The casing 100 includes a back cover 110 (shown in FIG. 1), and the casing 100 has an accommodation space 120 (shown in FIG. 1) inside. The speaker 200 is disposed in the accommodation space 120 of the casing 100, and a first chamber 210 (shown in FIG. 1) is defined between the speaker 200 and the back cover 110.

With reference to FIG. 1, FIG. 2B, and FIG. 3, the circuit board module 300 provided in this embodiment is disposed in the first chamber 210, and the circuit board module 300 includes a first circuit board 310, a second circuit board 320*m* and a first flexible connector 330. The first circuit board 310 includes a first surface 311. The second circuit board 320 includes a second surface 321 (shown in FIG. 3). As shown in FIG. 1, the first surface 311 of the first circuit board 310 faces and is spaced apart from the second surface 321 of the second circuit board 320.

In detail, as shown in FIG. 2C and FIG. 3, the first circuit board 310 provided in this embodiment further includes an electronic device 313 (shown in FIG. 3) disposed on the first surface 311, and the second circuit board 320 is spaced apart from the first circuit board 310 by the electronic device 313 on the first surface 311. In addition, the second circuit board 320 further includes a third surface 322 opposite to the second surface 321 and a solder pad 322A located on the third surface 322.

With reference to FIG. 1 and FIG. 2C, the first flexible connector 330 provided in this embodiment includes a first end 331, a second end 332, and a connection segment 333 connecting the first end 331 and the second end 332, the first end 331 and the second end 332 are opposite to each other, the first end 331 is connected to the first circuit board 310, and the second end 332 is connected to the second circuit board 320. The connection segment 333 is shaped as a letter U as shown in FIG. 2C.

Compared with the earphone provided in the related art, where the electronic devices are disposed on a circuit board with a length and width sufficient to accommodate all the electronic devices, in the earphone provided in this embodiment, a solder pad 322A is disposed on the third surface 322 of the second circuit board 320, and the second circuit board 320 covers the top of the first circuit board 310 so that the first surface 311 faces the second surface 321. Therefore, compared with the circuit board accommodating all the electronic devices, the area required by the solder pad 332A, if disposed on the circuit board, may be omitted from the first circuit board 310.

In this embodiment, note that the solder pad 322A is arranged on the third surface 322 of the second circuit board 320. However, in other embodiments of the disclosure, electronic devices other than the solder pad 322A may also be disposed on the second circuit board 320, which should not be construed as a limitation in the disclosure.

In this embodiment, the first circuit board 310 includes a cavity 312 recessed from an edge, and the first end 331 of the first flexible connector 330 extends into the cavity 312. The design of the cavity 312 in the first circuit board 310 allows the first flexible connector 330 to be connected to the first circuit board 310 at a relatively smooth angle, and the connection segment 333 of the first flexible connector 330 is allowed to be shaped as a letter U, so as to avoid damages to the first flexible connector 330 due to an excessive bending operation of the connection segment 333 during the bending process, which is conducive to maintaining or even prolonging the lifespan of the first flexible connector 330.

With reference to FIG. 2C and FIG. 3, the first circuit board 310 provided in this embodiment includes an electronic device 313 (shown in FIG. 3) located on the first surface 311, the electronic device 313 is located between the first surface 311 and the second surface 321, and the electronic device 313 is an active device. The second circuit board 320 leans against the electronic device 313 as shown in FIG. 2C, and a dimension of the second circuit board 320 is smaller than a dimension of the first circuit board 310. The electronic device 313 provided in this embodiment has a flat surface against which the second circuit board 320 may lean. However, in other embodiments, the device supporting the second circuit board 320 does not need to be the electronic device 313, but the first surface 311 of the first circuit board 310 needs to provide three higher devices as fulcrums so that the second circuit board 320 may lean, which should not be construed as a limitation in the disclosure. In addition, the electronic device 313 provided in this embodiment is a processor, but in other embodiments, the type of the electronic device 313 may not be a processor and is not limited in the disclosure.

In detail, an adhesion layer 321A (shown in FIG. 2C) is arranged on the second surface 321 of the second circuit board 320 provided in this embodiment, and the second circuit board 320 is adhered to the electronic device 313 through the adhesion layer 321A, so that the second circuit board 320 may lean against the electronic device 313 in a more stable manner. After the second circuit board 320 provided in this embodiment is flipped from the first circuit board 310 as shown in FIG. 3, note that the adhesion layer 321A should be adhered to the second surface 321 of the second circuit board 320. In FIG. 3 illustrating this embodiment, the adhesion layer 321A is omitted to clearly show the appearance of the second surface 321.

According to this embodiment, the first circuit board 310, the second circuit board 320, and the first flexible connector 330 are combined as a rigid-flex board. As such, the first flexible connector 330 may be electrically connected to the first circuit board 310 and the second circuit board 320 without using a connector (not drawn) or another electronic device, and thereby the design of the rigid-flex board may save the space occupied by the connector and the material cost in association with the use of the connector.

In addition, the second circuit board 320 provided in this embodiment is made of a flexible soft material, and the first circuit board 310 is made of a rigid material. As shown in FIG. 2B, after the second circuit board 320 covers the first circuit board 310 so that the second surface 321 faces the first surface 311, since the second circuit board 320 made of the flexible soft material is thinner than the first circuit board 310, the overall thickness of the circuit board module 300 is not increased, which ensures the light weight and the convenience of the earphone 10. In other embodiments, the second circuit board 320 may also be a rigid board or a flexible board equipped with another strengthening board, which should not be construed as a limitation in the disclosure.

With reference to FIG. 1, FIG. 2C, and FIG. 3 at the same time, the earphone 10 provided in this embodiment further includes a third circuit board 400 and a second flexible connector 500. The back cover 110 of the casing 100 has an extension stem 111 (shown in FIG. 1), and a second chamber 111A is defined in the extension stem 111 (shown in FIG. 1). The second chamber 111A is adjacent to the first chamber 210. The third circuit board 400 is disposed in the second chamber 111A and is electrically connected to the first circuit board 310 through the second flexible connector 500. To be specific, the second flexible connector 500 includes a third end 510 and a fourth end 520 opposite to each other, the third end 510 is electrically connected to the first circuit board 310, the fourth end 520 is electrically connected to the third circuit board 400, and the third end 510 and the fourth end 520 respectively extend along a direction away from each other.

Figure 4:
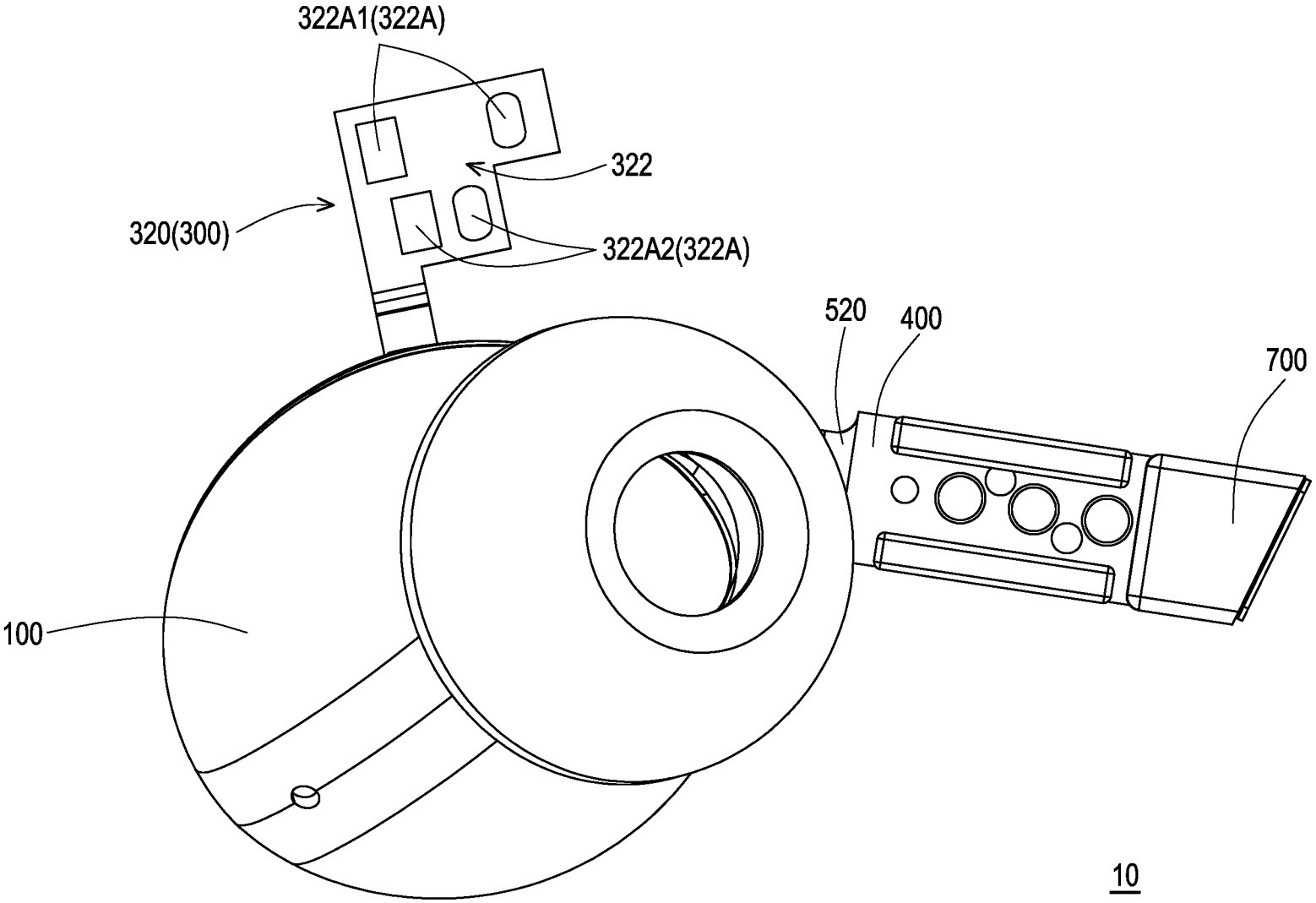
FIG. 4 is a bottom view of the earphone with the circuit board module depicted in FIG. 3.

FIG. 4 is a bottom view of the earphone with the circuit board module depicted in FIG. 3. With reference to FIG. 1 and FIG. 4, the earphone 10 provided in this embodiment further includes a battery 600 (shown in FIG. 1) and a microphone 700, and the battery 600 and the microphone 700 are connected to the solder pad 322A located on the third surface 322 through a conductive wire 800. The microphone 700 is disposed on the third circuit board 400. After the user wears the earphone 10, the location of the microphone 700 is, compared to the battery 600 located in the accommodation space 120, closer to the user's mouth, which is beneficial for the microphone 700 to collect sound.

According to the related art, the battery and the circuit board of the earphone are electrically connected to each other by arranging a plurality of springs (not shown) on the circuit board. By contrast, in one or more embodiments of the disclosure, the solder pad 322A1 of the battery 600 and the solder pad 322A2 of the microphone 700 are disposed on the third surface 322 of the second circuit board 320; together with the use of the conductive wire 800, the overall volume of the circuit board module 300 may be reduced, and the effects achieved by the springs of the related art may be replaced in this disclosure. In addition, use of the circuit board module 300 may further save the material cost of the springs. In other embodiments, electronic devices other than the solder pad 322A may be disposed on the third surface 322 of the second circuit board 320, which should however not be construed as a limitation in the disclosure.

To sum up, in the earphone provided in one or more embodiments of the disclosure, after the second circuit board covers the first circuit board so that the second surface faces the first surface, the overall area of the circuit board module may be effectively reduced in comparison with that provided in the related art; in addition, the second circuit board is made of a flexible soft material that does not affect the overall thickness of the circuit board module, and the overall dimension of the circuit board module may be reduced to comply with the consumers' requirements for light weight and convenience of the earphones. In addition, through the design of the cavity of the first circuit board provided in an embodiment, the first flexible connector may be connected to the first circuit board at a relatively smooth angle, and the connection segment of the first flexible connector may be shaped as the letter U, so as to avoid the damages to the first flexible connector due to the excessive bending operation of the connection segment during the bending process, which is conducive to maintaining or even prolonging the lifespan of the first flexible connector. Moreover, in an embodiment, the first circuit board, the second circuit board, and the first flexible connector are combined as a rigid-flex board, and thereby the design of the rigid-flex board may save the space occupied by the connector and the material cost in association with the use of the connector. In an embodiment of the disclosure, the use of the solder pad and the use of the conductive wire may also reduce the overall volume of the circuit board module and save the material cost of using the springs, so that the overall dimension and cost of the earphone may be further reduced.

It will be apparent to those skilled in the art that various modifications and variations can be made to the disclosed embodiments without departing from the scope or spirit of the disclosure. In view of the foregoing, it is intended that the disclosure covers modifications and variations provided they fall within the scope of the following claims and their equivalents.

What is claimed is:

1. An earphone with a circuit board module, the earphone comprising:

a casing, comprising a back cover and an accommodation space inside;

a speaker, disposed in the accommodation space of the casing, a first chamber being defined between the speaker and the back cover;

the circuit board module, disposed in the first chamber and comprising:

a first circuit board, comprising a first surface and a cavity recessed from an edge;

a second circuit board, comprising a second surface, the first surface of the first circuit board facing and being spaced apart from the second surface of the second circuit board; and a first flexible connector, comprising a first end, a second end opposite to the first end, and a connection segment connecting the first end and the second end, wherein the first end is connected to the first circuit board, the first end of the first flexible connector extends into the cavity, and the second end is connected to the second circuit board, wherein the connection segment is shaped as a letter U.

2. The earphone with the circuit board module according to claim 1, wherein the first circuit board comprises an electronic device located on the first surface, and the electronic device is located between the first surface of the first circuit board and the second surface of the second circuit board.

3. The earphone with the circuit board module according to claim 2, wherein the second circuit board leans against the electronic device, and a dimension of the second circuit board is smaller than a dimension of the first circuit board.

4. The earphone with the circuit board module according to claim 3, wherein an adhesion layer is arranged on the second surface of the second circuit board, and the second circuit board is adhered to the electronic device through the adhesion layer.

5. The earphone with the circuit board module according to claim 1, wherein the back cover of the casing has an extension stem, a second chamber is defined in the extension stem, and the second chamber is adjacent to the first chamber.

6. The earphone with the circuit board module according to claim 5, further comprising a third circuit board and a second flexible connector, wherein the third circuit board is disposed in the second chamber and electrically connected to the first circuit board through the second flexible connector.

7. The earphone with the circuit board module according to claim 5, wherein the second flexible connector comprises a third end and a fourth end opposite to each other, and the third end and the fourth end respectively extend along a direction away from each other.

8. The earphone with the circuit board module according to claim 1, wherein the first circuit board comprises an electronic device located on the first surface, the electronic device is an active device, and the second circuit board comprises a third surface opposite to the second surface and a solder pad located on the third surface.

9. The earphone with the circuit board module according to claim 8, further comprising a battery or a microphone, and the battery or the microphone is connected to the solder pad through a conductive wire.

* * * * *